US007293560B2

(12) United States Patent
Dahrendorf et al.

(10) Patent No.: US 7,293,560 B2
(45) Date of Patent: Nov. 13, 2007

(54) RESPIRATOR MASK WITH SUPPLEMENTARY PANELS

(75) Inventors: Klaus-Dieter Dahrendorf, Berlin (DE); Michael Horn, Berlin (DE); Detlef Kielow, Berlin (DE); Wolfgang Weber, Berlin (DE)

(73) Assignee: MSA Auer GmbH, Berlin (DE)

( * ) Notice: Subject to any disclaimer, the term of this patent is extended or adjusted under 35 U.S.C. 154(b) by 67 days.

(21) Appl. No.: 10/494,023

(22) PCT Filed: Sep. 20, 2002

(86) PCT No.: PCT/DE02/03639

§ 371 (c)(1),
(2), (4) Date: Oct. 15, 2004

(87) PCT Pub. No.: WO03/037439

PCT Pub. Date: May 8, 2003

(65) Prior Publication Data

US 2005/0060794 A1 Mar. 24, 2005

(30) Foreign Application Priority Data

Oct. 29, 2001 (DE) ..... 101 54 683

(51) Int. Cl.
*A62B 9/04* (2006.01)
*A62B 18/08* (2006.01)

(52) U.S. Cl. ..... 128/202.27; 128/201.14

(58) Field of Classification Search ..... 128/201.14, 128/201.15, 201.17, 201.24, 205.27, 206.19, 128/201.29, 202.11, 202.27, 206.23; 2/12, 2/432, 434, 441, 443

See application file for complete search history.

(56) References Cited

U.S. PATENT DOCUMENTS

| | | | | | |
|---|---|---|---|---|---|
| 2,677,824 | A | * | 5/1954 | Gay, Jr. et al. | 2/441 |
| 3,896,496 | A | * | 7/1975 | Leblanc et al. | 2/439 |
| 4,070,103 | A | * | 1/1978 | Meeker | 351/52 |
| 4,689,838 | A | * | 9/1987 | Angermann et al. | 2/441 |
| 4,934,807 | A | * | 6/1990 | Bolle et al. | 351/62 |
| 5,018,223 | A | * | 5/1991 | Dawson et al. | 2/436 |
| D352,726 | S | * | 11/1994 | Bolle | D16/312 |
| 5,410,763 | A | * | 5/1995 | Bolle | 2/436 |
| 5,617,588 | A | * | 4/1997 | Canavan et al. | 2/428 |
| 5,642,530 | A | * | 7/1997 | Parks | 2/435 |
| 5,685,022 | A | * | 11/1997 | Essman et al. | 2/434 |
| 6,102,033 | A | * | 8/2000 | Baribeau et al. | 128/201.24 |
| 6,317,897 | B1 | * | 11/2001 | Chiang | 2/428 |
| 6,789,273 | B2 | * | 9/2004 | Markovitz | 2/436 |
| D537,097 | S | * | 2/2007 | Freeman | D16/309 |

FOREIGN PATENT DOCUMENTS

| | | |
|---|---|---|
| GB | 2266247 | * 10/1993 |
| WO | WO92/20405 | * 11/1992 |

* cited by examiner

*Primary Examiner*—Teena Mitchell
(74) *Attorney, Agent, or Firm*—Wood, Phillips, Katz, Clark & Mortimer

(57) ABSTRACT

In a respirator mask in which the visor panels can be covered by light-absorbing supplementary panels, first and second snap-in hooks are molded onto opposite sides of the visor panel and a stop is molded onto a corner section to form a guide pocket. The outer contour lines and the convexity of the visor panel and the supplementary panel are identical. To attach the flexurally elastic supplementary panel, it is first fastened in the guide pocket and on the first snap-in hook. Then the opposite side is locked into the second snap-in hook after flexing the supplementary panel.

24 Claims, 2 Drawing Sheets

RESPIRATOR MASK
3
7
2
4
9
1
6
12

4
6
7
11
8a
12
8b
10
9b
8
9
9a
1

RESPIRATOR MASK WITH SUPPLEMENTARY PANELS

BACKGROUND OF THE INVENTION

1. Field of the Invention

This invention relates to respirator masks with supplementary panels that can be attached as light filters in front of the visor panels provided in the facepiece.

2. Background Art

Visor panels are inserted at the wearer's eye level into the respirator facepiece that is made of a flexible material. The practice to attach supplementary panels made of a light-filtering material in front of the visor panels, if required, to protect the eyes against light rays that can damage them or impair vision by dazzling effects is known. Mask bodies typically feature a frame around the perimeter of the visor panels for attaching supplementary panels while these supplementary panels are embedded in a rubber collar around their rims. Attaching the supplementary panels requires fitting the rubber collar onto the frame and is a tedious and time-consuming activity that becomes even more difficult when the wearer has to wear protective gloves. Moreover, the eyes must be protected immediately to prevent damage in some applications involving rays of light, which cannot be done in the required time frame without the help of others when using the known supplementary panel systems. In addition to the complex design involving a frame and a collar, another disadvantage of the supplementary panels and their attachment systems in use is that they take considerable space and make reading instrument displays very difficult.

SUMMARY OF THE INVENTION

It is therefore the problem of this invention to design a respirator mask and temporarily attachable supplementary panels for light filtering in such way that when in use, i.e. when someone is wearing the mask, the wearer can attach supplementary panels fast and without requiring help from others and that the attachment system is to protrude from the facepiece as little as possible.

The general inventive idea is, in other words, that a flexurally elastic supplementary panel that is identical with the visor panel in outer contour and convexity is attached using snap-in means integrated into opposing side rim sections of the visor panel, and that a guide element is molded onto the visor panel for fast and correct positioning of the attachment. To attach the supplementary panel, it is first aligned on the visor panel using the guide element, then locked into the first snap-in means and finally locked completely into the second snap-in means after flexing it slightly so that it sits close to the visor panel.

Both the visor panel and the supplementary panel have a simple design and can be produced at low cost. The supplementary panels can be attached in no time while wearing the respirator, without requiring tools or help from others. The supplementary panel is fastened securely but it is also no problem to take it off. Another advantage is its small space requirement; the overall height of the visor area is just increased by the thickness of the supplementary panel.

The guide element is formed by a stop that is molded to a corner area of the rim of the visor panel and defines a guide pocket. The snap-in means are two snap-in hooks molded to two opposite rim sections of the visor panel and consisting of a vertical web and a horizontal holding web. Recesses are molded into the supplementary panel where the panel would be under the snap-in hook when attached so that the upper edge of the snap-in hooks is flush with the surface of the supplementary panel.

According to another characteristic of the invention, the supplementary panel is concave towards the visor panel so the slight flexing required for attachment and removal is quite simple. A recess is shaped into the rim area of the supplementary panel to provide a fingerhold for flexing the panel. This makes it easier to handle the supplementary panel during attachment and removal.

BRIEF DESCRIPTION OF THE DRAWINGS

An embodiment of the invention is explained in greater detail below with reference to the figures. Wherein.

DETAILED DESCRIPTION OF THE PREFERRED EMBODIMENT

Figure 1:
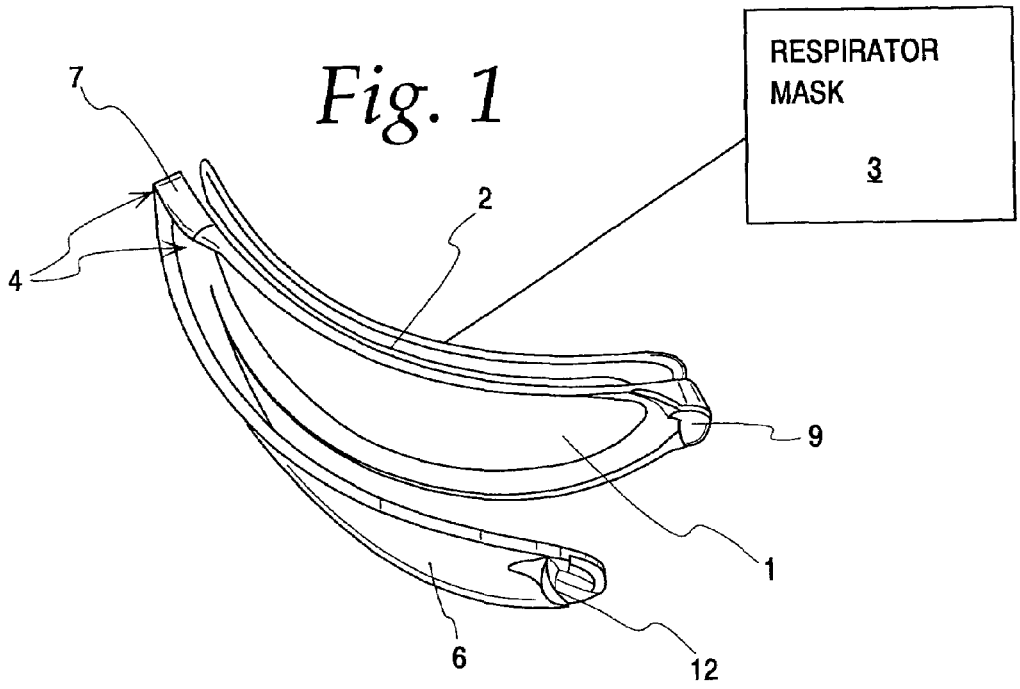
FIG. 1 shows a perspective top view of a visor panel and a partially attached supplementary panel shortly before snapping it into the visor panel.
Figure 2:
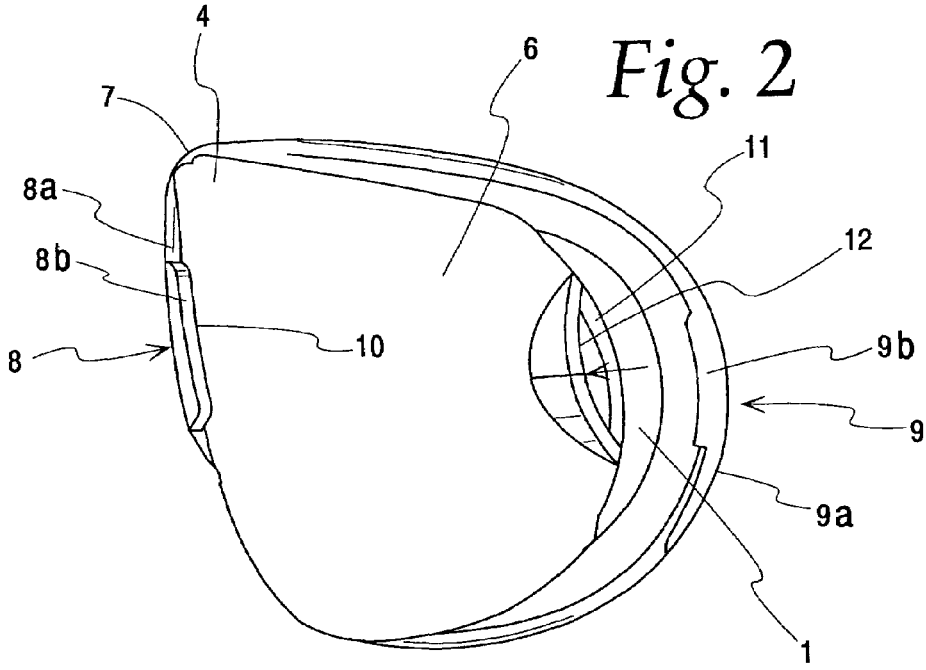
FIG. 2 shows a front view of the visor and supplementary panel system according to FIG. 1.
Figure 3:
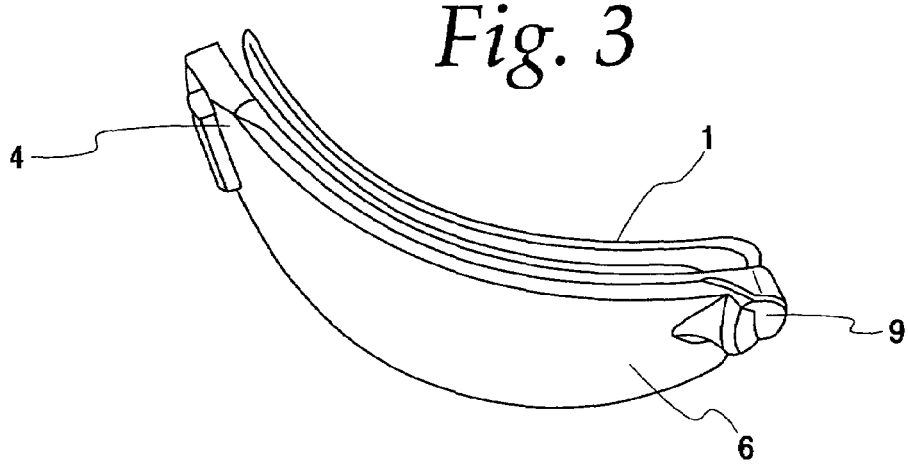
FIG. 3 shows a top view of the visor and supplementary panel system with the supplementary panel fully attached.
Figure 4:
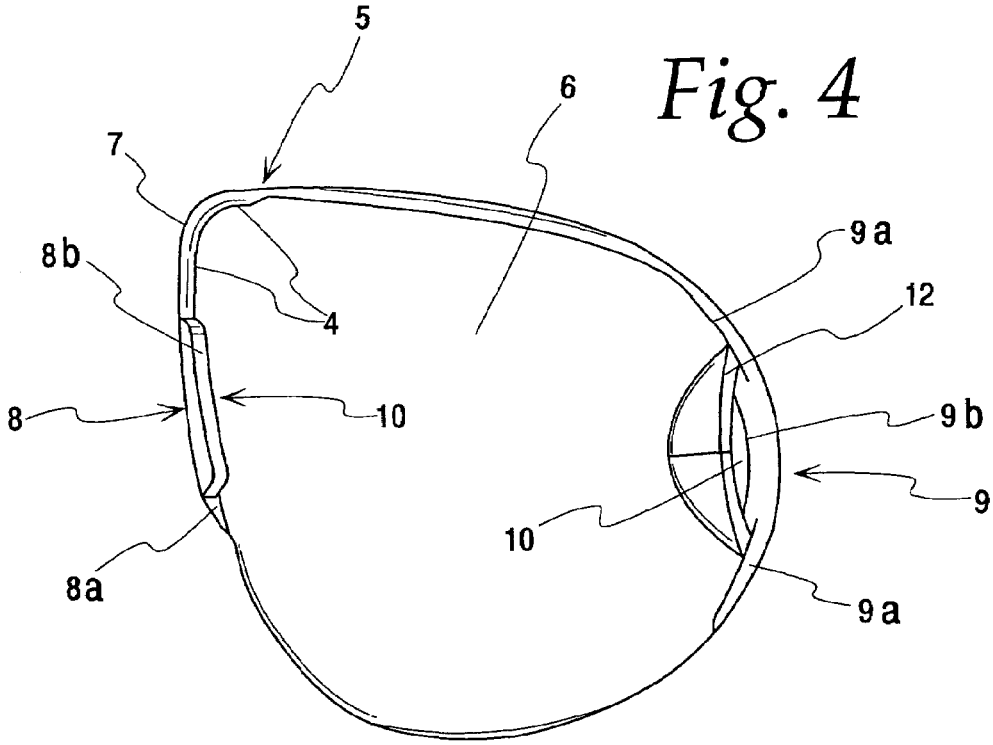
FIG. 4 shows a front view of the system according to FIG. 3.

A system for attaching a supplementary panel to a respirator mask will now be described with reference to FIGS. 1-4.

A visor panel 1 is convex and comprises a lens and a circumferential groove 2 through which the visor panel 1 is connected with a respirator mask 3.

A guide pocket 4 is formed in an angular rim section 5 of the visor panel 1 for correct positioning of a supplementary panel 6 on the visor panel 1. The supplementary panel 6 has a lens that is located at the front of the lens on the visor panel 1 and functions as a light filter. The guide pocket 4 is formed by a stop 7 that protrudes vertically from the visor panel surface. First and second snap-in hooks 8 and 9, each of which consisting of a vertical web 8*a* or 9*a*, stretching from the visor panel surface and a holding web 8*a* or 9*a* pointing in horizontal direction towards the center of the visor panel, are molded to opposite rim sections of the visor panel 1. It is apparent from FIG. 4 that the stop 7 merges with the web 8*a* of the first snap-in hook 8.

The shape of the supplementary panel 6 is similar to the visor panel 1 in outer contour lines and convexity and, like the lens on the visor panel 1, extends sidewise continuously between the sides of a wearer's head to reside in front of both of a wearer's eyes. First and second recesses 10, 11 (reductions in thickness of material) that are slightly longer and wider than the horizontal webs 8*b* or 9*b* of the respective snap-in hook are molded into the supplementary panel 6 in the rim section where the supplementary panel is captively located under the first snap-in hook 8 and the second snap-in hook 9. The snap-in hooks 8, 9 reside one each at the sides of a wearer's head. A fingerhold 12 is formed in front of the second recess 11 on the supplementary panel 6. The supplementary panel 6 can be slightly flexed into one direction due to its convex design.

The supplementary panel 6 is moved sideways relative to the visor panel 1 to be attached to the visor panel 1 as follows:

The supplementary panel 6 is moved generally sideways relative to the visor panel to be inserted with its angular (pointed) side into the guide pocket 4 until it rests against the stop 7 and thus becomes automatically aligned with the visor panel 1. The first recess 10 in the supplementary panel 6 slides under the first snap-in hook 8 so that the supplementary panel 6 is locked in on one side of the visor panel 1. As the wearer presses a finger onto the fingerhold 12 in the direction of the arrow in FIG. 2, the supplementary panel 6 is flexed sideways somewhat more so that the sideways dimension of the supplementary panel is effectively reduced and the second recess in the supplementary panel 6 becomes located under the second snap-in hook 11, then the supplementary panel 6 stretches due to its intrinsic elasticity and the second recess 11 slides under the second snap-in hook 9. Thus the supplementary panel 6 is securely locked in vertical direction to the visor panel surface but fixed in all lateral horizontal directions due to the curved shape of the holding web 9*a* and the stop 7. The supplementary panel 6 can easily be detached from the visor panel 1 when the wearer presses in lateral direction on the fingerhold 12; the supplementary panel 6 is thus flexed somewhat more so that it slides out of the second snap-in hook 9 and can be removed in upward direction.

The supplementary panels can be attached easily, fast and securely while wearing the respirator mask without requiring help from others due to the visor panel design with a guide pocket and stop as well as snap-in hooks on opposite rim sections of the visor panel. The supplementary panel basically rests on the visor panel so that the overall height of the attachment in front of the visor panel is determined by the thickness of the supplementary panel and thus very small.

LIST OF REFERENCE SYMBOLS

1 visor panel
2 groove
3 angular rim section
4 guide pocket
5 supplementary panel
6 stop
7 first snap-in hook
7*a* vertical web
7*b* horizontal web
8 second snap-in hook
8*a* vertical web
8*b* horizontal web
9 first recess
10 second recess
11 fingerhold

The invention claimed is:

1. A supplementary panel attaching system that can be attached to a respirator mask to provide light filters in front of a visor panel provided on the respirator mask, the panel attaching system comprising:

a visor panel with a first lens;

a flexurally elastic supplementary panel that is similar in shape to the visor panel and has an angular side and comprising a second lens;

a first stop in an angular rim section of the visor panel to form a guide pocket together with a front surface of the visor panel and a first snap-in hook that emerges from the visor panel; and a second snap-in hook molded onto the rim section of the visor panel opposite the first snap-in hook wherein the supplementary panel can be directly fastened to the visor panel, the guide pocket and angular side of the supplementary panel configured so that the angular side of the supplementary panel can be guidingly slid towards and into the guide pocket so as to consistently align the supplementary panel with the visor panel, the visor panel having spaced first and second sides, the first stop and first snap-in hook located at the first side of the visor panel, the second snap-in hook located at the second side of the visor panel.

2. The supplementary panel attaching system according to claim 1 wherein a recess is molded into the rim of the supplementary panel at a side of the supplementary panel in a section that is level with the respective snap-in hook.

3. The supplementary panel attaching system according to claim 1 wherein a fingerhold for flexing the supplementary panel when the supplementary panel is locked onto the visor panel or removed from the visor panel is formed into a front surface of the supplementary panel on the side opposite from the first snap-in hook and the guide pocket.

4. The supplementary panel attaching system according to claim 1 in combination with a respirator mask.

5. The supplementary panel attaching system according to claim 1, wherein the snap-in hooks each comprises a vertical web that follows a contour line of the visor panel and a horizontal holding web.

6. The supplementary panel attaching system according to claim 1 wherein a recess formed by a reduction in thickness of material is molded into the rim of the supplementary panel in a side section that is level with a respective snap-in hook.

7. The supplementary panel attaching system according to claim 1 wherein the supplementary panel and the visor panel each extends continuously between the sides of a wearer's head to reside in front of both of a wearer's eyes and has a convex shape between the snap-in hooks.

8. The supplementary panel attaching system according to claim 1 wherein a fingerhold for flexing the supplementary panel when the supplementary panel is locked onto the visor panel or removed from the visor panel is formed into the supplementary panel.

9. The supplementary panel attaching system according to claim 1 wherein the supplementary panel has a convexly curved front surface and a correspondingly curved concave rear surface and the concave rear surface rests on a convexly curved surface at the front of the visor panel between the second sides.

10. The supplementary panel attaching system according to claim 1 wherein the supplementary panel is captively held only at the first and second sides at each of the sides of a wearer's head.

11. The supplementary panel attaching system according to claim 1 wherein the supplementary panel has spaced sides and must be flexed in a sideways direction so that a sideways dimension of the supplementary panel is effectively reduced and thereafter released to be placed captively under the first and second snap-in hooks.

12. A supplementary panel attaching system that can be attached to a respirator mask to provide light filters in front of a visor panel provided on the respirator mask, the panel attaching system comprising:

a visor panel with a first lens and spaced first and second sides;

a flexurally elastic supplementary panel that is similar in shape to the visor panel and comprising a second lens;

a stop in an angular rim section of the visor panel to form a guide pocket together with a surface of the visor panel and a first snap-in hook that emerges from the visor panel at the first side of the visor panel; and a second snap-in hook molded onto the rim section of the visor panel opposite the first snap-in hook at the second side of the visor panel, wherein the supplementary panel can be directly fastened to the visor panel between the first and second snap-in hooks, wherein the snap-in hooks consist of a vertical web that follows a contour line of the visor panel and a horizontal holding web that can be engaged by the supplementary panel by moving the supplementary panel sideways relative to the visor panel.

13. The supplementary panel attaching system according to claim 12 in combination with a respirator mask.

14. The supplementary panel attaching system according to claim 12 wherein the visor panel has spaced sides and a front and the supplementary panel has a convexly curved front surface and a correspondingly curved concave rear surface and the concave rear surface rests on a convexly curved surface at the front of the visor panel between the spaced sides.

15. The supplementary panel attaching system according to claim 12 wherein the supplementary panel has spaced sides and must be flexed in a sideways direction so that a sideways dimension of the supplementary panel is effectively reduced and thereafter released to be placed captively under the first and second snap-in hooks.

16. The supplementary panel attaching system according to claim 12 wherein the supplementary panel comprises a unitary piece that extends continuously between the first and second snap-in hooks that are located one each adjacent the sides of a wearer's head.

17. The supplementary panel attaching system according to claim 12 wherein the first and second snap-in hooks are spaced horizontally from each other.

18. A supplementary panel attaching system that can be attached to a respirator mask to provide light filters in front of a visor panel provided on the respirator mask, the panel attaching system comprising:

a visor panel having spaced first and second sides with a first lens;

a flexurally elastic supplementary panel that is similar in shape to the visor panel and comprising a second lens;

a stop in an angular rim section of the visor panel to form a guide pocket together with a surface of the visor panel and a first snap-in hook that emerges from the visor panel at the first side of the visor panel; and a second snap-in hook molded onto the rim section of the visor panel at the second side of the visor panel opposite the first snap-in hook wherein the supplementary panel can be directly fastened to the visor panel, wherein the supplementary and visor panels each extends continuously between the first and second snap-in hooks between the sides of a wearer's head to reside in front of both of a wearer's eyes.

wherein the supplementary panel and the visor panel have a convex shape between the snap-in hooks.

19. The supplementary panel attaching system according to claim 18 in combination with a respirator mask. 1 wherein the supplementary panel has a convexly curved front surface and a correspondingly curved concave rear surface and the concave rear surface rests on a convexly curved surface at the front of the visor panel between the first and second sides.

20. The supplementary panel attaching system according to claim 18 wherein the visor panel has spaced sides and a front and the supplementary panel has a convexly curved front surface and a correspondingly curved concave rear surface and the concave rear surface rests on a convexly curved surface at the front of the visor panel between the spaced sides.

21. The supplementary panel attaching system according to claim 18 wherein the supplementary panel has spaced sides and must be flexed in a sideways direction so that a sideways dimension of the supplementary panel is effectively reduced and thereafter released to be placed captively under the first and second snap-in hooks.

22. The supplementary panel attaching system according to claim 18 wherein the supplementary panel comprises a unitary piece that extends continuously between the first and second snap-in hooks that are located one each adjacent the sides of a wearer's head.

23. The supplementary panel attaching system according to claim 18 wherein the first and second snap-in hooks are spaced horizontally from each other.

24. A supplementary panel attaching system that can be attached as to a respirator mask to provide light filters in front of a visor panel provided on the respirator mask, the panel attaching system comprising:

a visor panel;

a flexurally elastic supplementary panel that is similar in shape to the visor panel;

a first stop in an angular rim section of the visor panel to form a guide pocket together with a front surface of the visor panel and a first snap-in hook that emerges from the visor panel; and a second snap-in hook molded onto the rim section of the visor panel opposite the first snap-in hook wherein the supplementary panel can be directly fastened to the visor panel, the visor panel having spaced first and second sides, the first stop and first snap-in hook located at the first side of the visor panel, the second snap-in hook located at the second side of the visor panel, the first and second snap-in hooks residing one each at the sides of a wearer's head, wherein a fingerhold for flexing the supplementary panel when the supplementary panel is locked onto the visor panel or removed from the visor panel is formed into a surface of the supplementary panel to be accessible at the front of the supplementary panel at a side thereof with the respirator mask worn by a user on the side opposite from the first snap-in hook and the guide pocket.

* * * * *

UNITED STATES PATENT AND TRADEMARK OFFICE

CERTIFICATE OF CORRECTION

PATENT NO. : 7,293,560 B2
APPLICATION NO. : 10/494023
DATED : November 13, 2007
INVENTOR(S) : Klaus-Dieter Dahrendorf et al.

It is certified that error appears in the above-identified patent and that said Letters Patent is hereby corrected as shown below:

Col. 4, line 50 (claim 9) should read as follows:

--curved surface at the front of the visor panel between the first and--

Signed and Sealed this

Tenth Day of June, 2008

JON W. DUDAS
*Director of the United States Patent and Trademark Office*